US009603390B2

(12) United States Patent
Li et al.

(10) Patent No.: US 9,603,390 B2
(45) Date of Patent: Mar. 28, 2017

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Youlin He, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 293 days.

(21) Appl. No.: 14/340,559

(22) Filed: Jul. 24, 2014

(65) Prior Publication Data

US 2015/0335073 A1 Nov. 26, 2015

(30) Foreign Application Priority Data

May 23, 2014 (CN) ..... 2014 2 0266716 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2012/0279512 A1* 11/2012 Hon ..... A24F 47/008 131/329
2013/0312776 A1* 11/2013 Newton ..... A24F 47/008 131/329
2014/0338684 A1* 11/2014 Liu ..... A24F 47/008 131/329
2014/0355969 A1* 12/2014 Stern ..... A24F 47/008 392/390

* cited by examiner

*Primary Examiner* — Michael H Wilson
*Assistant Examiner* — Eric Yaary
(74) *Attorney, Agent, or Firm* — Cheng-Ju Chiang

(57) ABSTRACT

An atomizer with a compact structure and convenient assembly is provided. The atomizer includes an atomizing sleeve and an atomizing assembly fixed therein, a liquid reserving space configured for storing a tobacco liquid is defined in the atomizing sleeve. The atomizing assembly includes a fixing sleeve and a porous body arranged therein, an aerosol passage and at least one liquid opening are formed in the fixing sleeve. The porous body absorbs tobacco liquid through the at least one liquid opening, and the porous body is hollow inside and having an atomizing space defined therein. A heating coil configured for heating tobacco liquid absorbed from the porous body into tobacco aerosol is fixed in the atomizing space. The aerosol passage configured for ejecting the tobacco aerosol is in communication with the atomizing space. An electronic cigarette having the atomizer is also provided.

8 Claims, 5 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

Electronic cigarettes are similar to conventional cigarettes in both appearance and taste, but less harmful to human's health. Accordingly, electronic cigarettes are widely used for helping people to quit smoking. Atomizers are key components of the electronic cigarettes. In a typical atomizer, a glass fiber core is disposed horizontally through an air pipe to get a tobacco liquid in a liquid reserving chamber. However, the atomizer is not unaesthetic on one hand, on the other hand, the glass fiber core may detach from the air pipe after a long-time use, especially when the atomizer falls on ground.

Therefore, what is needed, is an atomizer and an electronic cigarette having same, which can overcome the above shortcomings.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present atomizer and electronic cigarette. Moreover, in the drawings, like reference numerals designate corresponding parts throughout the several views.

DETAILED DESCRIPTION

Embodiments of the present disclosure will now be described in detail below and with references to the drawings.

Figure 1:
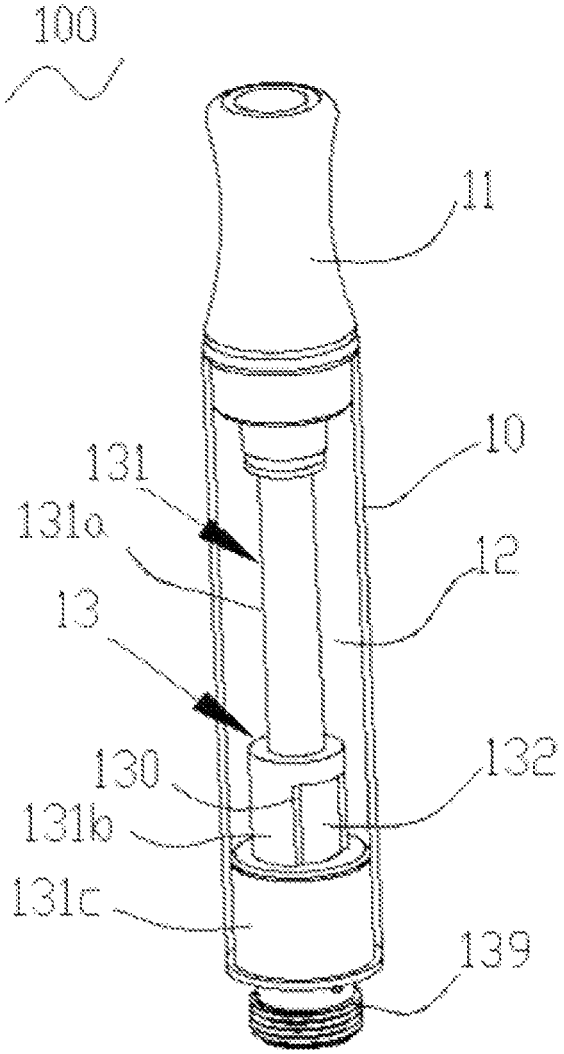
FIG. 1 is a schematic view of an atomizer according to a first embodiment.
Figure 2:
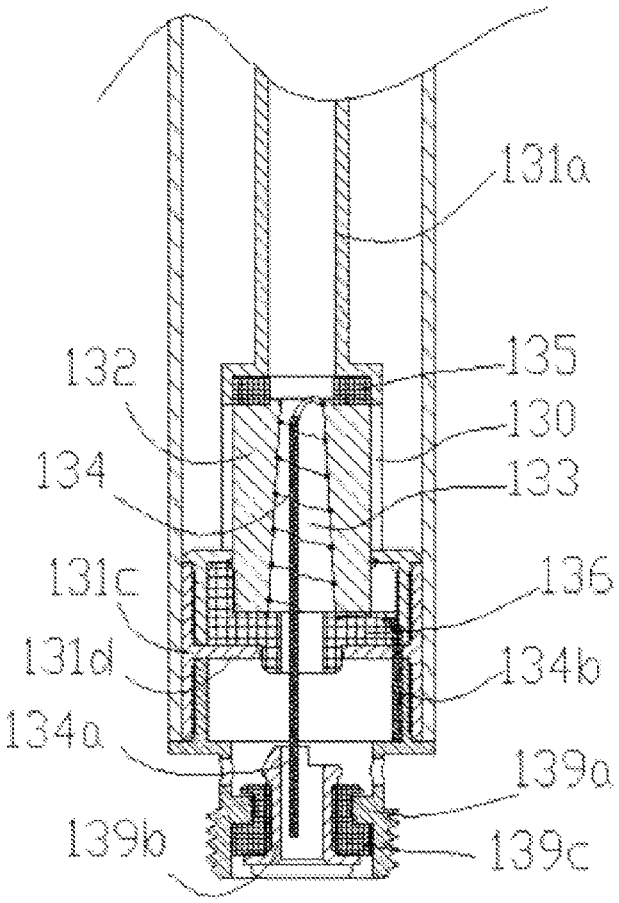
FIG. 2 is a partially cross-sectional view along a liquid opening of the atomizer of FIG. 1.
Figure 3:
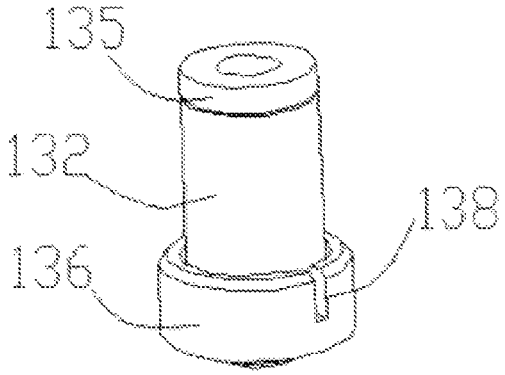
FIG. 3 is a schematic assembled view showing a liquid stopper coupled with a porous body of FIG. 2.

Referring to FIGS. 1-3, an atomizer 100 includes an atomizing sleeve 10, a mouthpiece 11 inserted into one end of the atomizing sleeve 10, and an atomizing assembly 13 fixed in the atomizing sleeve 10. The atomizing sleeve 10 is made of a transparent material, and defines a liquid reserving space 12 therein. The liquid reserving space 12 is configured for reserving a tobacco liquid.

The atomizing sleeve 10 includes a fixing sleeve 131, a porous body 132 disposed in the fixing sleeve 131, and a connector 139 arranged at the other end of the atomizing sleeve 10. The connector 139 is configured for connecting an external device, for example, a power supply device.

The fixing sleeve 131 includes an upper part 131*a*, a middle part 131*b* and a lower part 131*c*. The upper part 131*a*, middle part 131*b*, and lower part 131*c* are interconnected and integrally formed. The upper part 131*a* extends upwards and is substantially level to one end of the atomizing sleeve 10, and the lower part 131*c* extends downwards and is substantially level to the other end of the atomizing sleeve 10. Each of the upper part 131*a*, the middle part 131*b*, and the lower part 131*c* is cylindrical, outer diameters of the upper part 131*a*, the middle part 131*b* and the lower part 131*c* increase in sequence. In addition, an aerosol passage is formed in an inner space of the upper part 131*a*, middle part 131*b*, and the lower part 131*c*, so that an air pipe is not needed.

Two liquid openings 130 are respectively formed at a peripheral wall of the middle part 131*b*, preferably, the two liquid openings 130 are symmetrically arranged about a central axis of the middle part 131*b*. The liquid openings 130 are in communicate with an inner space of the middle part 131*b* and the liquid reserving space 12, so that the porous body 132 can absorb tobacco liquid from the liquid reserving space 12 through the two liquid openings 130. In the present embodiment, the two liquid openings 130 are square-shaped, in other embodiments, the two liquid openings 130 can be circular or polygonal or other shapes. As known, a size of the liquid opening 130 can control a liquid absorbing ability of the porous body 132. Preferably, in other embodiments, only one liquid opening 130 can be formed in the middle part 131*b* when the porous body 132 can absorb enough tobacco liquid.

The porous body 132 is made of ceramic and is hollow inside, and the side wall of the porous body 132 is microporous to absorb and reserve a part of the tobacco liquid. In the present embodiment, the porous body 132 is cylindrical-shaped and has a cylindrical surface facing towards the liquid opening 130 to absorb the tobacco liquid, besides, the larger the cylindrical surface contacts the liquid opening 130, the more the tobacco liquid can be absorbed. An atomizing space 133 is formed in the porous body 132, and the atomizing space 133 is cone-shaped, with an inner diameter of the atomizing space 133 decreasing in sequence from the bottom to the top of the middle part 131*b*. A heating coil 134 configured for heating the tobacco liquid absorbed from the porous body 132 is fixed in the atomizing space 133. The heating coil 134 is helical formed along an axial direction and is fixed in the porous body 132. Specially, the cone-shaped atomizing space 133 can be beneficial for the heating coil 134's assembly.

Specifically, a top liquid stopper 135 is fixed above the porous body 132, and a bottom liquid stopper 136 is fixed below the porous body 132. In addition, the top liquid stopper 135 abuts with the upper part 131*a* of the fixing sleeve 131, and the bottom liquid stopper 136 abuts with the lower part 131*c* of the fixing sleeve 131. Two through holes are respectively formed in the center of the top liquid stopper 135 and the center of the bottom liquid stopper 136, and communicate with the aerosol passage of the fixing sleeve 131 and the atomizing space 133 of the porous body 132. Both the top liquid stopper 135 and the bottom liquid stopper 136 are made of silicone material, thus preventing the un-atomized tobacco liquid from the side wall of porous body 132 from leaking into the fixing sleeve 131.

In the present embodiment, two protruding flanges 131*d* are respectively arranged at the upper part 131*a* and the lower part 131*c* of the fixing sleeve 131 to fix the top liquid stopper 135 and the bottom liquid stopper 136, in addition, the flange 131*d* of the upper part 131*a* protrudes outwards, and the flange 131*d* of the lower part 131*c* protrudes inwards. In other embodiments, a slot for reserving tobacco liquid can be fixed on the flange 131*d*, or the flange can be directly made of silicone, such that the top liquid stopper 135 and the bottom liquid stopper 136 can be avoided.

A wire groove 138 is formed on a side wall of the bottom liquid stopper 136. One end 134*b* of the heating coil 134 is electrically connected to the connector 139 through the wire groove 138, and the other end 134*a* of the heating coil 134 is electrically connected to the connector 139 through the through hole of the bottom liquid stopper 136 and the aerosol passage of the lower part 131*c*. In the present embodiment, the connector 139 includes a conductive screw sleeve 139*a*, an electrode ring 139*b* fixed in the screw sleeve 139*a*, and an insulating ring 139*c* fixed between the screw sleeve 139*a* and the electrode ring 139*b*, the screw sleeve 139*a* can be configured as a negative electrode, and the electrode ring 139*b* can be configured as a positive electrode.

In conclusion, the porous body 132 is arranged in the fixing sleeve 131 and absorbs tobacco liquid through the liquid opening 130 formed on the fixing sleeve 131, an atomizing space is formed in the porous body 132, an aerosol passage 133 is formed in the fixing sleeve 131 and communicates with the atomizing space, thus the atomizing assembly 13 has a compact structure, convenient assembly, and better atomizing effect, the atomizer 10 having an aesthetic appearance.

Figure 4:
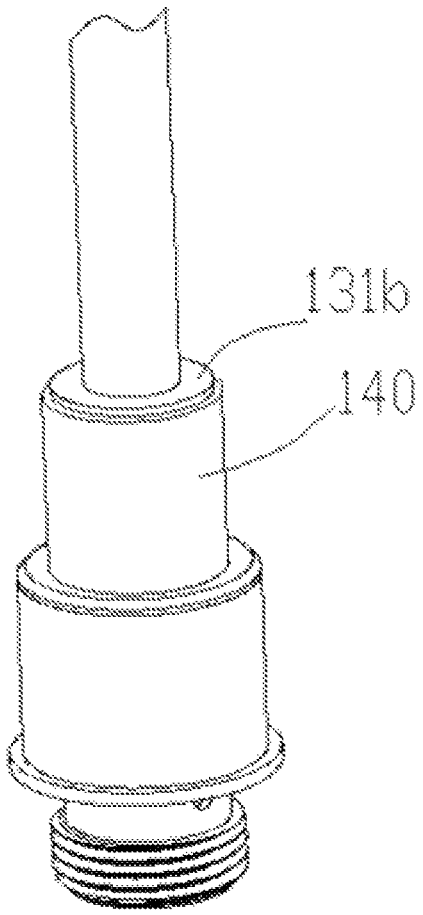
FIG. 4 is a schematic view of an atomizing assembly of an atomizer according to a second embodiment.

Referring to FIG. 4, an atomizer in accordance with a second embodiment is provided. A liquid reserving member 140 wraps around a periphery of a middle part 131*b* of an atomizing assembly, and a porous body 132 absorbs a tobacco liquid from the liquid reserving member 140 through a liquid opening. A wrapping quantity of the liquid reserving member 140 depends on practical necessity, however, excess tobacco liquid being absorbed into the porous body 132 with a fast velocity will lead to the tobacco liquid cannot be atomized in time, therefore, a liquid absorbing quantity and a liquid absorbing velocity of the porous body 132 can be controlled by the liquid reserving member 140, thus preventing the tobacco liquid from being absorbed into the porous body 132 too much and too fast.

Figure 5:
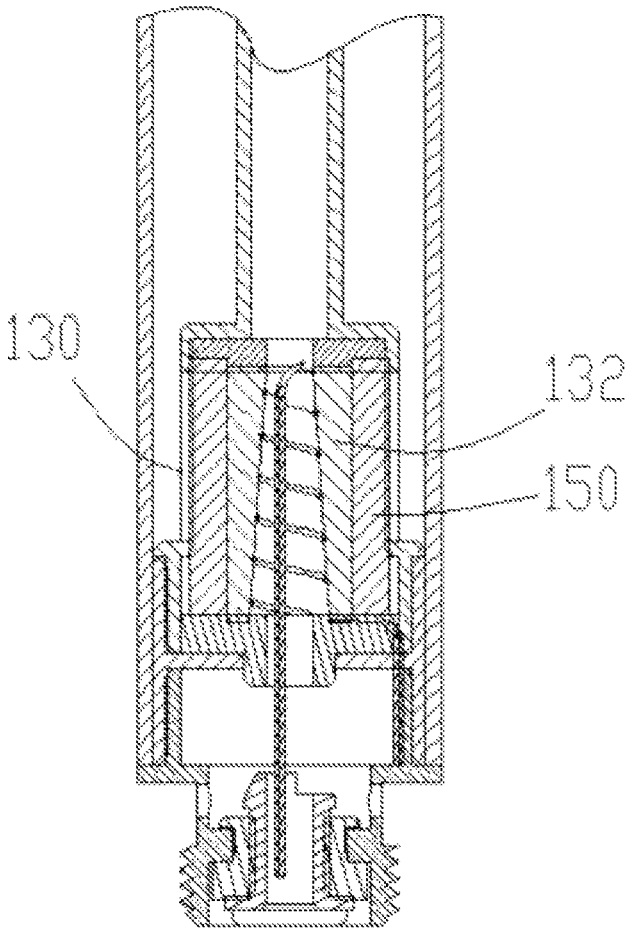
FIG. 5 is a partially cross-sectional view of an atomizer along a liquid opening according to a third embodiment.

Referring to FIG. 5, an atomizer in accordance with a third embodiment is provided. A porous body 132 has a periphery, at least partially the periphery of the porous body 132 has a liquid reserving member 150 wrapped thereon. The liquid reserving member 150 is fixed in a middle part 131*b* of a fixing sleeve and faces towards a liquid opening 130 to absorb tobacco liquid.

Figure 6:
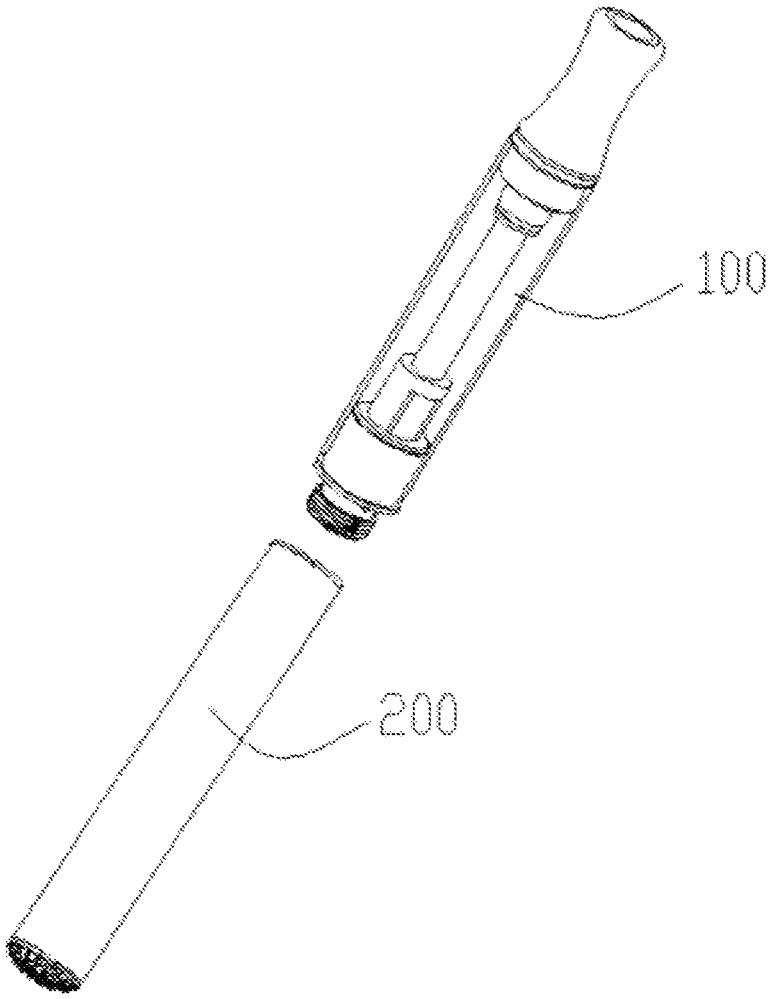
FIG. 6 is a schematic view of an electronic cigarette according to a fourth embodiment.

Referring to FIGS. 1 and 6, an electronic cigarette including an atomizer 100 and a power supply 200 in accordance with a fourth embodiment is provided. In the present embodiment, the power supply 200 is detachably connected to a connector 139 of the atomizer 100 by screw connection, and is configured for providing electrical power to the atomizer 100. The atomizer 100 can be any atomizer of the first embodiment to the third embodiment.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer of an electronic cigarette, comprising:

an atomizing sleeve defining a liquid reserving space therein; and an atomizing assembly fixed in the atomizing sleeve;

the atomizing assembly comprising a fixing sleeve and a porous body arranged in the fixing sleeve, the fixing sleeve having an aerosol passage defined therein and at least one liquid opening, the porous body absorbing a tobacco liquid through the at least one liquid opening, the porous body being hollow inside and having an atomizing space defined therein, the atomizing space having a heating coil fixed therein, and the heating coil configured for heating the tobacco liquid absorbed from the porous body into tobacco aerosol, the aerosol passage in communication with the atomizing space and configured for ejecting the tobacco aerosol;

wherein the fixing sleeve comprises an upper part, a middle part, and a lower part, the upper part, middle part and the lower part are interconnected, the at least one liquid opening are formed on the middle part, and the porous body is arranged in the middle part;

wherein a top liquid stopper and a bottom liquid stopper are respectively fixed on each of two ends of the porous body and abut with the upper part and the lower part of the fixing sleeve respectively, two through holes are respectively formed in a center of the top liquid stopper and in a center of the bottom liquid stopper and in communication with the aerosol passage and the atomizing space.

2. The atomizer of claim 1, wherein the atomizing sleeve is made of a transparent material, the upper part and the lower part of the fixing sleeve are respectively extend to be substantially level to two ends of the atomizing sleeve, the upper part, the middle part, and the lower part are cylindrical respectively, and outer diameters of the upper part, the middle part, and the lower part increase in sequence.

3. The atomizer of claim 1, wherein the porous body is arranged in the middle part along an axial direction of the middle part, the atomizing space is cone-shaped, and an inner diameter of the atomizing space is decreased in sequence from the bottom to the top of the middle part.

4. The atomizer of claim 1, wherein two protruding flanges configured for fixing the top liquid stopper and the lower liquid stopper are respectively fixed on the upper part and the lower part of the fixing sleeve.

5. The atomizer of claim 1, wherein the porous body is made of ceramic and has a cylindrical surface facing towards the at least one liquid opening to absorb tobacco liquid.

6. The atomizer of claim 1, wherein a liquid reserving member wraps around at least partially the middle part of the fixing sleeve, the porous body contacts with the liquid reserving member through the at least one liquid opening.

7. The atomizer of claim 1, wherein a liquid reserving member wraps around at least partially the porous body, the liquid reserving member is arranged in the middle part of the fixing sleeve and faces towards the liquid opening.

8. An electronic cigarette comprising a battery assembly and an atomizer of claim 1, the battery assembly configured to be electrically connected to the atomizer.

* * * * *